United States Patent [19]

Pope

[11] 4,289,151

[45] Sep. 15, 1981

[54] TWIN CURLING IRON

[76] Inventor: Jessie M. Pope, 3300 West Warren, Detroit, Mich. 48208

[21] Appl. No.: 53,175

[22] Filed: Jun. 29, 1979

[51] Int. Cl.[3] ..... A45D 2/24

[52] U.S. Cl. ..... 132/37 R

[58] Field of Search ..... 132/37 R, 36, 36.2, 132/37, 32 A, 32 B, 32 R; 219/225

[56] References Cited

U.S. PATENT DOCUMENTS

| | | | |
|---|---|---|---|
| 1,488,621 | 4/1924 | Simmons | 132/32 A |
| 1,618,306 | 2/1927 | Pedersen | 132/37 R |
| 4,151,850 | 5/1979 | Nathe | 132/37 R |

FOREIGN PATENT DOCUMENTS

| | | | |
|---|---|---|---|
| 477521 | 6/1929 | Fed. Rep. of Germany | 132/32 A |

*Primary Examiner*—G. E. McNeill

*Attorney, Agent, or Firm*—Harvey B. Jacobson

[57] ABSTRACT

A pair of elongated levers are provided and pivotally connected intermediate their opposite ends and define first and second pairs of corresponding lever ends. The levers are relatively swingable in at least closely adjacent parallel planes and the first pair of lever ends each include a pair of generally parallel end portions spaced apart in generally the same corresponding plane and generally paralleling the longitudinal extent of the corresponding lever. A first pair of the generally parallel end portions define elongated channel members opening laterally in the same direction paralleling the corresponding plane and the second pair of end portions of parallel end portions define elongated presser members seated in the channel members with one of the presser members disposed between the channel members and one of the channel members disposed between the presser members. The levers are relatively pivotal to laterally swing the presser members outwardly of the channel members and the spacing between the channel members is sufficient to enable the aforementioned one presser member to be swung from the seated position within the corresponding channel member without contacting the other channel member. One pair of the end portions have electrical resistance heating structure operatively associated therewith.

3 Claims, 4 Drawing Figures

TWIN CURLING IRON

BACKGROUND OF THE INVENTION

Various forms of twin curling irons and similar structures have been heretofore provided such as those disclosed in U.S. Pat. Nos. 951,798, 1,147,296, 1,558,913, 1,611,580 and 1,694,672. However, these forms of twin curling irons include laterally spaced pairs of channel defining portions and corresponding presser members and are therefore designed primarily for the purpose of imparting a wavy effect to the hair known as the Marcel wave. However, Marcel wave-type hair styles are no longer popular, but instead other types of hair curling which may be accomplished through the utilization of the single form of curling iron have become more popular. Although the single curling iron may accomplish the desired curling operation, the forming of numerous curls with a single curling iron is time consuming and thus boring to the person whose hair is being curled and a limitation on the production of the operator performing the curling operation. Accordingly, a need exists for an improved curling iron whereby the desired curling operation may be accomplished more quickly.

BRIEF DESCRIPTION OF THE INVENTION

The curling iron of the instant invention includes two channel member portions and presser member portions, but each pair of coacting channel and presser members are designed to function independently of the other and thus the pairs of channel and presser members are disposed in superposed relation as opposed to laterally spaced relation. Through the utilization of the twin curling iron of the instant invention, two curls may be simultaneously formed although the curling iron is utilized in the same manner as a single form of curling iron.

The main object of this invention is to provide a curling iron which will greatly increase the production of a hair stylist.

Another object of this invention is to provide a hair curler which will greatly reduce the time a patron of a hair stylist must spend while having his or her hair curled.

Another important object of this invention is to provide a curling iron which may be proficiently utilized by beauticians and other person performing hair curling operations.

A final object of this invention to be specifically enumerated herein is to provide a curling iron in accordance with the preceding objects and which will conform to conventional forms of manufacture, be of simple construction and easy to use so as to provide a device that would be economically feasible, long lasting and relatively trouble free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 2, 3, 4:
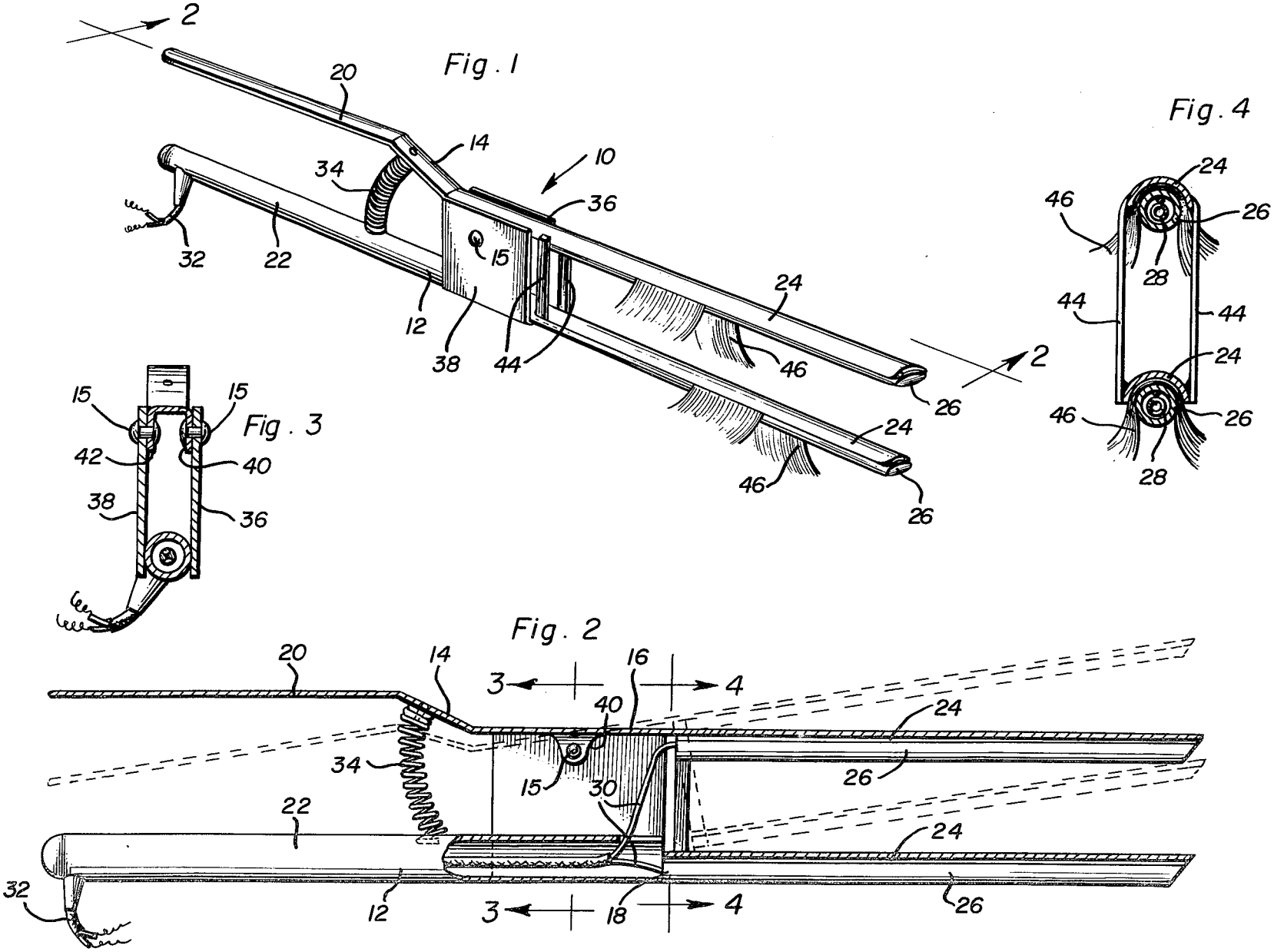
FIG. 1 is a perspective view of the curling iron of the instant invention.
FIG. 2 is an enlarged longitudinal, vertical sectional view taken substantially upon the plane indicated by the section line 2—2 of FIG. 1.
FIG. 3 is a transverse vertical sectional view taken substantially upon the plane indicated by the section line 3—3 of FIG. 2.
FIG. 4 is an enlarged transverse vertical sectional view taken substantially upon the plane indicated by the section line 4—4 of FIG. 2.

Referring now more specifically to the drawings, the numeral 10 generally designates the twin curling iron of the instant invention. The iron 10 includes a pair of elongated levers 12 and 14 pivotally connected together as at 15. The levers define first and second pairs of lever ends 16, 18 and 20, 22 and the first pair of lever ends 16, 18 include corresponding pairs of generally parallel end portions 24, 26. The first pair of end portions 24, supported from the lever end 16, define elongated channel members opening laterally in the same direction parelleling the plane in which the corresponding lever 14 is swingable and the second pair of end portions 26, supported from the lever end 18, define elongated generally cylindrical presser members seated in the channel members 24. One of the presser members 26 is disposed between the channel members 24 and one of the channel members 24 is disposed between the presser members 26.

The levers are relatively pivotal to laterally swing the presser members 26 outwardly of the open sides of the channel members 24 and the spacing between the channel members 24 is sufficient to enable the presser member disposed between the channel members 24 to be swung from its channel member without contacting the other channel member. In addition, the end portions 26 include electrical resistance heating elements 28 disposed therein for heating the presser members 26. Suitable conductors 30 are electrically connected to the electrical resistance heating elements 28 and are in turn electrically connected to an extension cord portion 32 for operative connection with a suitable source of electrical potential. The second pair of lever ends 20 and 22 have a compression spring 34 disposed therebetween and the opposite ends of spring 34 are connected to the lever ends 20 and 22. The spring 34 yieldingly biases apart the lever ends 20 and 22 and the first and second end portions 24 and 26 are yieldingly biased toward positions with the cylindrical presser members 26 seated in the channel members 24.

The lever end 22 comprises a handle and the lever end 20 comprises a thumb engageable lever end whereby the levers 12 and 14 may be relatively angularly displaced to swing the first pair of lever ends 20 and 22 toward each other and the first and second end portions 24 and 26 away from each other.

The lever 12 includes a pair of opposite side mounting plates 36 and 38 supported therefrom and the lever 14 includes opposite side mounting ears 40 and 42 adjacent its midportion and which are received between the plates 36 and 38 and are pivotally supported therefrom by means of the fasteners 15.

The upper channel member 24 includes a pair of opposite side depending supports 44 from which corresponding opposite side portions of the lower channel member 24 are supported. Accordingly, the channel members 24 are supported from the lever 14 and the presser members 26 are supported from the lever 12.

In operation, the curling iron 10 may be utilized in generally the same manner as a conventional single form of curling iron, except that two locks 46 of hair may be clamped between corresponding channel and presser members 24 and 26 and simultaneously curled. Because the corresponding channel members 24 and presser members 26 are vertically spaced as opposed to being arranged in side-by-side fashion and are relatively swingable in substantially the same plane, the curling iron 10 may be effectively used in the same manner in which a single curling iron is conventionally used, except that two locks 46 may be simultaneously curled.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A twin curling iron including a pair of elongated levers pivotally connected intermediate their opposite ends and defining first and second pairs of corresponding lever ends, said first pair of lever ends each including a pair of generally parallel end portions spaced apart and disposed in a single plane generally paralleling the longitudinal extent of the corresponding levers, a first pair of said end portions defining elongated channel members opening laterally in the same direction paralleling said plane with a first channel member opening toward the second and the second opening away from the first channel member, the other pair of said end portions defining elongated presser members seated in said channel members with one of said presser members disposed between said channel members and said second channel member disposed between said presser members, said levers being relatively pivotable to laterally swing said presser members in said plane outwardly of said channel members and the spacing between said channel members being sufficient to enable said one presser member to be swung outwardly of the corresponding channel member without contacting the other channel member, one pair of said end portions having electrical resistance heating means operatively associated therewith for heating said one pair of end portions.

2. The combination of claim 1 wherein said one pair of end portions comprises said presser members.

3. The combination of claim 1 including spring means operatively connected between said levers yieldingly biasing said levers toward positions with said presser members seated in said channel members.

* * * * *